US007918195B2

(12) United States Patent
McCall, III et al.

(10) Patent No.: US 7,918,195 B2
(45) Date of Patent: Apr. 5, 2011

(54) AIR-COOLED ENGINE HEAT EXTRACTOR

(75) Inventors: John T. McCall, III, Palm Bay, FL (US); George W. McCall, III, Palm Bay, FL (US); Bruce Brandt, Palm Bay, FL (US); John T. McCall, II, Palm Bay, FL (US)

(73) Assignees: George McCall, III, Palm Bay, FL (US); John T. McCall, III, Palm Bay, FL (US); John T. McCall, II, Palm Bay, FL (US)

( * ) Notice: Subject to any disclaimer, the term of this patent is extended or adjusted under 35 U.S.C. 154(b) by 448 days.

(21) Appl. No.: 12/028,805

(22) Filed: Feb. 9, 2008

(65) Prior Publication Data

US 2008/0210180 A1 Sep. 4, 2008

Related U.S. Application Data

(60) Provisional application No. 60/889,060, filed on Feb. 9, 2007.

(51) Int. Cl.
*F01P 1/02* (2006.01)

(52) U.S. Cl. ..... 123/41.7; 123/195 C; 244/53 R; 440/37

(58) Field of Classification Search ..... 123/41.7, 123/41.52, 41.71, 41.56, 41.58, 41.6, 41.61, 123/195 R, 195 A, 195 C; 440/37; 180/68.1
See application file for complete search history.

(56) References Cited

U.S. PATENT DOCUMENTS

| | | | | | |
|---|---|---|---|---|---|
| 778,455 | A | * | 12/1904 | Lewis | 123/41.6 |
| 1,783,085 | A | * | 11/1930 | Halford | 123/41.6 |
| 2,729,201 | A | * | 1/1956 | Rohm | 123/41.6 |
| 3,520,283 | A | * | 7/1970 | Forstner et al. | 123/41.62 |
| 3,788,264 | A | | 1/1974 | Gibson | |
| 4,047,508 | A | * | 9/1977 | Schramm | 123/41.6 |
| 4,779,588 | A | * | 10/1988 | Ziegler et al. | 123/41.61 |

* cited by examiner

*Primary Examiner* — Michael Cuff
*Assistant Examiner* — Hung Q Nguyen
(74) *Attorney, Agent, or Firm* — John L. DeAngelis; Beusse Wolter Sanks Mora & Maire, P.A.

(57) ABSTRACT

A heat extractor for attachment to an air-cooled engine. A cooling fan extends from the engine and is rotated by action of the engine. The heat extractor comprises a first thermally conductive surface for attachment to the engine, a plurality of flaps extending from the first surface, wherein when the heat extractor is attached to the engine the flaps extend away from the engine, a flared end region formed in the first surface, the flared end region nearest the cooling fan when the heat extractor is attached to the engine and wherein rotation of the cooling fan causes air to be drawn across the first surface, the plurality of flaps and the flared end region.

11 Claims, 5 Drawing Sheets

AIR-COOLED ENGINE HEAT EXTRACTOR

This patent application claims the benefit under Section 119(e) of the provisional patent application assigned Application No. 60/889,060 filed on Feb. 9, 2007.

FIELD OF THE INVENTION

The present invention relates to a heat extractor for an air-cooled engine.

BACKGROUND OF THE INVENTION

It is known that in some applications an air-cooled engine may not be adequately cooled by the natural air flow directed over the engine. Thus the engine may run "hot," possibly causing excessive cylinder wall and piston ring wear and premature engine failure. Air cooled engines used in air boats are especially prone to such failures as the air flow over the engine may be blocked by air boat seats, passengers, the operator, etc. Any object in front of the engine blocks the cooling air flow across the engine and therefore causes the engine temperature to increase. The cooling air flows from the front of the engine toward the rear of the engine. In an air boat the cooling air is forced across the engine by the forward motion of the boat and also by the action of the propeller. Air boat operators are advised to closely monitor the engine temperature to avoid high temperature operation but few do. Generally, the engine temperature should be maintained at less than about 500° F. for safe and efficient operation.

BRIEF DESCRIPTION OF THE DRAWINGS

The present invention can be more easily understood and the advantages and uses thereof more readily apparent when the following detailed description of the invention is read in conjunction with the figures wherein.

In accordance with common practice, the various described features are not drawn to scale, but are drawn to emphasize specific features relevant to the invention. Like reference characters denote like elements throughout the figures and text.

DETAILED DESCRIPTION OF THE INVENTION

Before describing in detail exemplary heat extractors for use with an air-cooled engine, it should be observed that the present invention resides primarily in a novel and non-obvious combination of elements. So as not to obscure the disclosure with details that will be readily apparent to those skilled in the art, certain conventional elements have been presented with lesser detail, while the drawings and the specification describe in greater detail other elements pertinent to understanding the invention.

The following embodiments are not intended to define limits as to the structure of the invention, but only to provide exemplary constructions. The described embodiments are permissive rather than mandatory and illustrative rather than exhaustive.

The heat extractor of the present invention facilitates the extraction or dissipation of heat from the air cooled engine, in particular from the cylinders and the cylinder heads. The heat extractor attaches to the engine proximate the cylinders and the cylinder heads to reduce the temperature of the cylinders and heads, which in turn reduces the engine temperature and the engine oil temperature. The reduced engine temperature helps to maintain a higher oil viscosity resulting in cleaner engine oil. The higher oil viscosity also reduces wear and tear on internal engine parts and extends operational time between maintenance actions. Maintaining a lower engine temperature, as provided by the heat extractor of the present invention, also reduces fuel consumption thereby increasing fuel efficiency.

Figure 1:
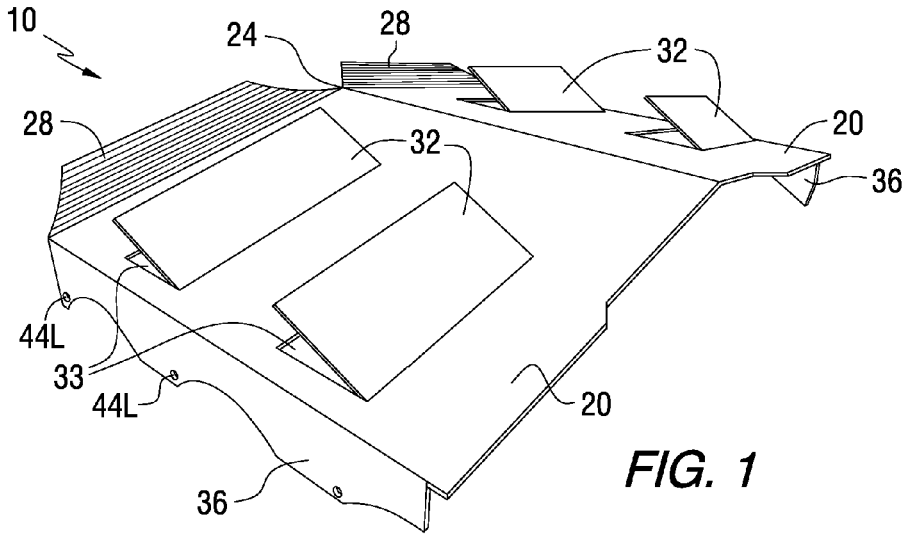
FIG. 1 is perspective view of a first embodiment of a heat extractor.

FIG. 1 illustrates a perspective view of a heat extractor or shroud 10 of the present invention. When in use with an engine, major surfaces 20 of the shroud 10 are spaced apart from the air cooled engine, while other portions of the shroud are attached to the engine. The shroud provides a thermal conduction path away from the engine and air is drawn over and under the shroud to further improve its heat extraction characteristics.

The shroud 10 comprises two major surfaces 20 extending from a common centerline line 24. The two major surfaces 20 meet to form an angle, typically an obtuse angle, at the centerline line 24. When attached to an engine, the centerline 24 of the shroud 10 is substantially aligned with a midline of the engine. Each of the two major surfaces 20 further comprises a flared end region 28 (proximate a propeller-end of the engine) and one or more raised surfaces or flaps 32, each defining an opening 33 in one of the surfaces 20. The flaps 32 may have the same or different dimensions. For example, the flaps 32 nearer a front of the engine may have a shorter length than the flaps 32 at the propeller-end of the engine. The flared end regions 28 are illustrated as curved surfaces (curving upward or away from the engine). In another embodiment the flared end regions comprise a flat surface inclined upwardly.

Figure 16:
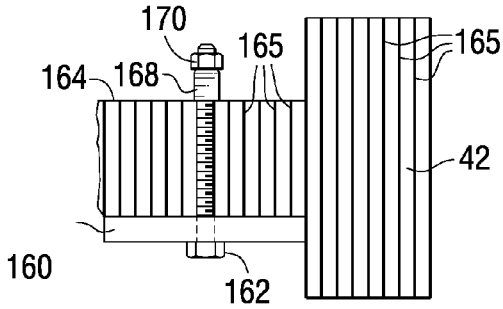
FIGS. 16 and 17 illustrate respective side and top views of a portion of the engine and the cooling plates of FIG. 15 mounted thereto.

Generally, an air cooled engine for use in an airboat comprises four or six cylinders, each cylinder having a plurality of cooling fins 165 (see FIG. 16) encircling at least a portion of each cylinder and the cylinder heads. Air passing between adjacent fins removes heat from the cylinders. Each cylinder is closed by a cylinder head or a piston head 42 attached to the cylinder walls by bolts 43. See FIG. 2. The cylinder heads 43 may also include cooling fins, as illustrated in FIG. 16. It is known that the cylinders and the cylinder heads are the hottest regions of the engine and therefore require removal of the greatest amount of heat.

Figure 2:
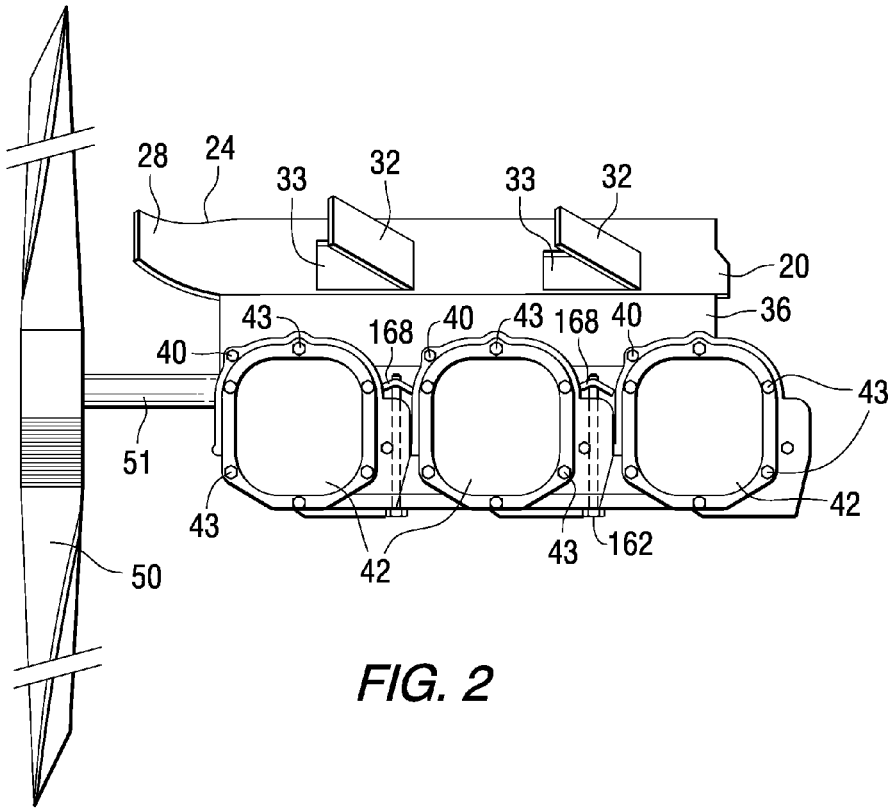
FIG. 2 is a right side view of an air-cooled engine including a partial view of the first embodiment of the heat extractor.

As also illustrated in FIG. 2, a propeller 50 attached to an shaft 51 is driven by the engine. The airboat is propelled through the water or snow by action of the propeller 50.

In the exemplary shroud embodiment of FIG. 2, a side surface 36 extends from each major surface 20 to provide an attachment surface for attaching the heat extractor 10 to the engine. Bolts 40 (¼-20 bolts in one embodiment) extend through holes 44 in the side surfaces 36 and through holes proximate to or formed in the piston heads 42. FIG. 2 illustrates three bolts 40 for attaching the heat extractor 10 to the engine. The heat extractor 10 is similarly attached to the left side of the engine, which is not illustrated the Figures. In other embodiments, including for use with 8-cylinder engines, more bolts 40 may be required. The shape, size and contours of the side surfaces 36 are determined by the dimensions, outline, cylinder count and cylinder configuration of the engine to which the shroud 10 is attached. Since the scale of FIG. 2 is greater than the scale of FIG. 1, the major surface 20 and the flaps 32 appear smaller in FIG. 2.

Figure 13:
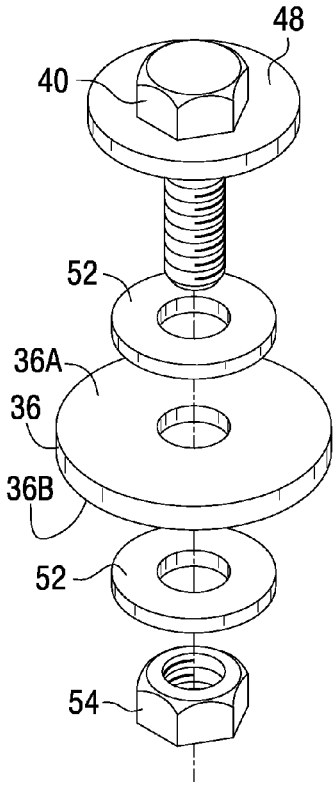
FIG. 13 is an exploded view illustrating attachment of the heat extractor to the engine.

One technique for attaching one of the side surfaces 36 to the engine is illustrated in the exploded view of FIG. 13. The bolt 40 passes through an opening in a structural element 48 extending from the cylinder head 42 or another element of the engine. Washers 52 are disposed on both surfaces 36A and 36B of the side surface 36. A nut 54 is threaded onto the bolt 40 to secure the surface 36 and thus the shroud 10 to the engine. In one embodiment each of the washers 52 comprises a stainless steel surface and an opposing rubber surface. When affixed to the engine, the washers 52 are oriented with the rubber surfaces in contact with the side surface 36 of the heat extractor 10. The rubber tends to reduce vibrations in the shroud 10.

The shroud 10 draws heat from the piston heads 42 by conduction through the thermally conductive material of the shroud 10. The rotating propeller 50 causes air to be drawn across the shroud 10 to reduce the shroud temperature causing additional heat to be withdrawn from the engine. This in turn reduces the engine temperature and the engine oil temperature to produce the advantageous effects described above. The flaps 32 and the flared end regions 28 tend to break up the air flow, causing air turbulence (vortex) that increases the rate at which the air flow extracts heat from the shroud 10. The heat extractor 10 also provides beneficial cooling effects even after the air boat engine and the propeller 50 have stopped. In this situation the shroud 10 allows the engine cylinders to cool uniformly.

Figure 3:
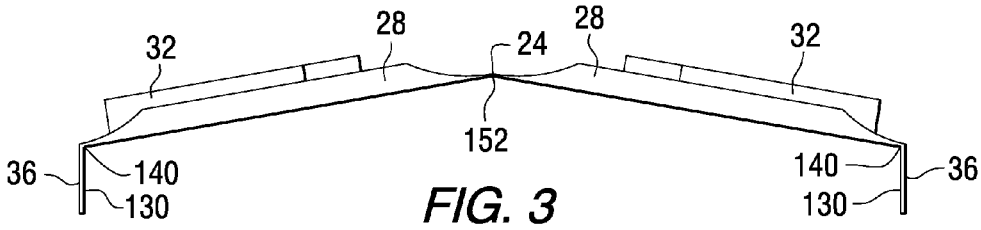
FIG. 3 is a rear view of the first embodiment of the heat extractor.
Figure 4:
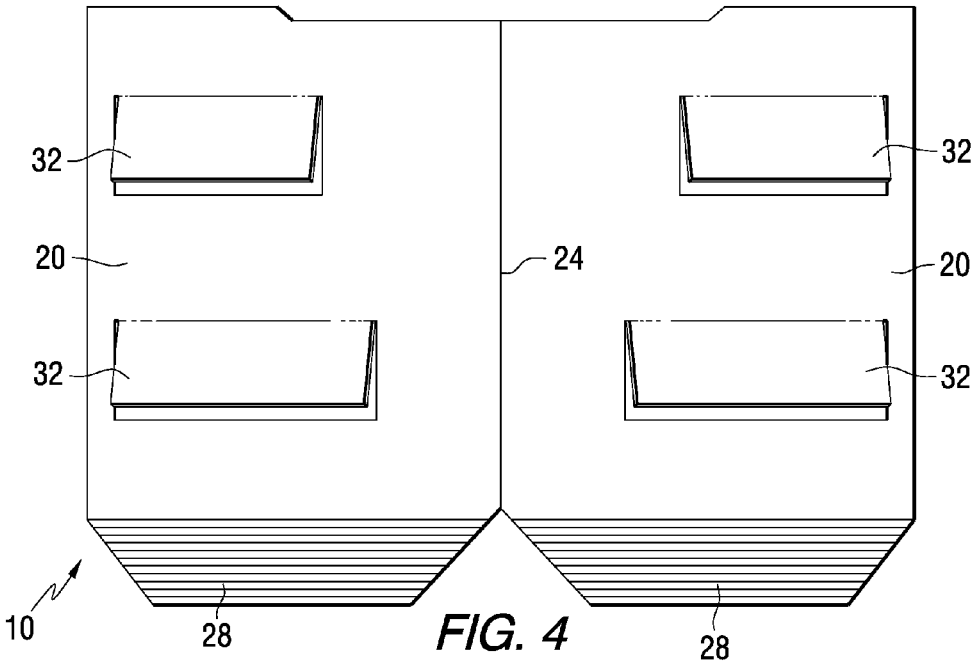
FIG. 4 is a top view of the first embodiment of the heat extractor.
Figure 5:
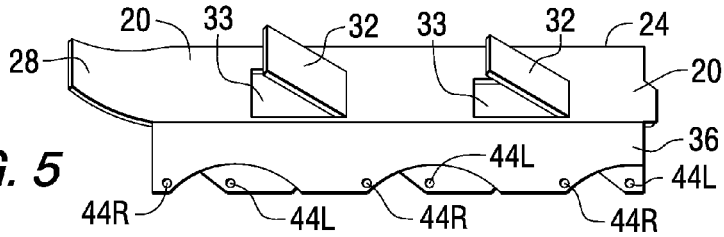
FIGS. 5 and 6 are respective right and left side views of the first embodiment of the heat extractor.
Figure 6:
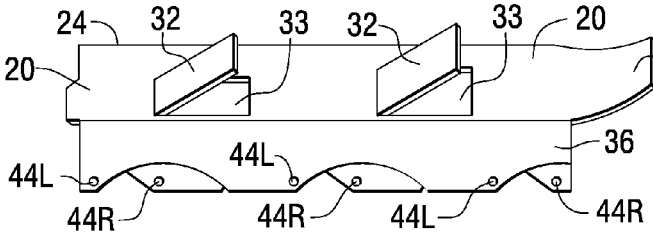
Figure 7:
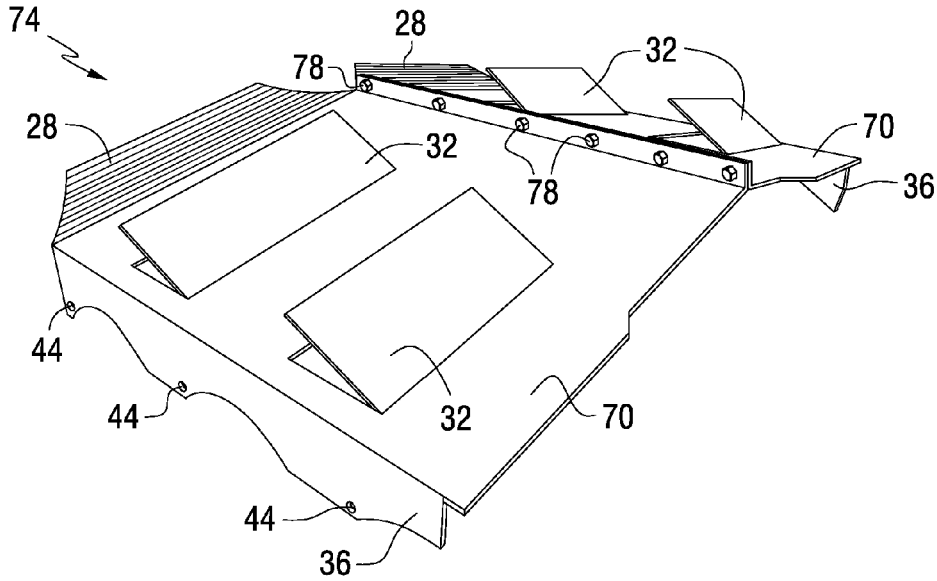
FIG. 7 is a perspective view of a second embodiment of a heat extractor.
Figure 8:
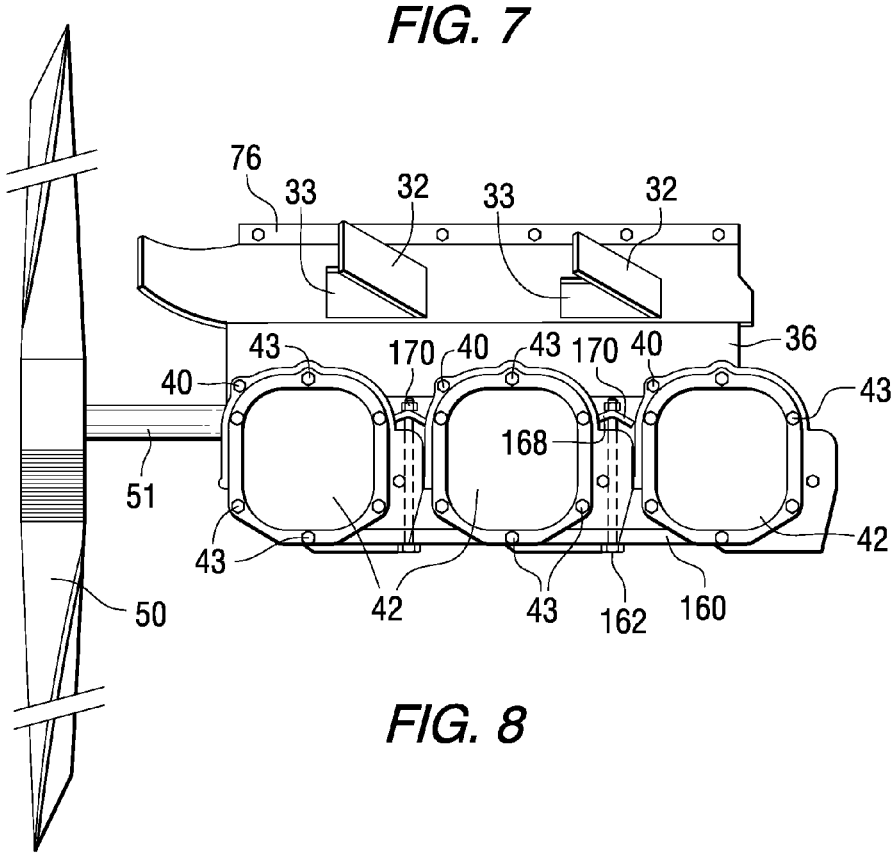
FIG. 8 is a right side view of an air cooled engine including a partial view of the second embodiment of the heat extractor.

FIG. 3 illustrates a rear view, FIG. 4 a top view, FIG. 5 a right side view and FIG. 6 a left side view of the shroud 10 of the present invention. In FIGS. 5 and 6 the holes in the right side surface 36 for attaching the shroud 10 to the right side of the engine are designated by reference characters 44R and in the left side surface 36 the holes are designated 44L.

When attached to an air boat engine as illustrated in FIG. 2, the airboat propeller 50 creates a vacuum that pulls the air heated by the engine across the shroud 10 creating a vortex that draws cooling air around the top and bottom surfaces of the cylinders 42 and the shroud 10 to maintain a cooler engine. The flaps 32 and their associated openings 33 draw heat from the engine by taking advantage of the vortex created by the propeller 50 and the cooling air provided thereby. Generally, the heat extractor 10 dissipates heat conducted from the engine and further streamlines and directs air flow across the engine within a region proximate the engine surfaces. The shroud 10 thus provides cooler and more efficient engine operation.

In another embodiment the extractor comprises a two-piece assembly, each piece comprising a major surface 70, with the two surfaces 70 connected together along mating edges (the common line 24) to form a heat extractor 74. See FIGS. 7-12.

In one embodiment the two surfaces 70 are bolted together at overlapping connecting edges 76 by inserting five (in an exemplary embodiment) bolt/nut combinations 78 (in one embodiment comprising ¼-20 by ½ inch bolts and mating nuts) through aligned holes 80. See FIGS. 7-12.

The single-piece embodiment shroud 10 of FIGS. 1-6 tends to be more efficient and visually more appealing than the two piece embodiment of FIGS. 7-12.

Figure 14:
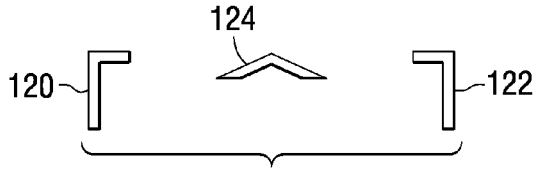
FIG. 14 illustrates support plates for the heat extractor.

Preferably, a material of the shroud 10/74 exhibits high thermal conductivity, such as aluminum. Aluminum is also beneficial due to its relatively light weight. In one embodiment the material of the heat extractor 10/74 comprises aluminum having a thickness of about 1/16 inch (about 0.090 ga.). In another embodiment, the shroud 10/74 further comprises side reinforcement plates 120 and 122 and a center reinforcement plate 124, as illustrated in FIG. 14, The left and right reinforcement plates 120 and 122 have substantially the same shape, size, contour and hole locations as the left and right side surfaces 36 of the shroud 10/74. The plates 120 and 122 are attached to an inside surface of the side surfaces 36 with one or both of double-sided adhesive tape strips and rivets. In one embodiment the tape comprises a one inch width of tape number 4611 (a VHB tape product) available from 3M® of St. Paul, Minn. In addition to securing the components together, the tape dampens vibrations in the shroud 10/74 and is resistant to temperature cycling. The reinforcement plates 120, 122 and 124 also dampen vibrations (thereby preventing shroud cracking) and improve the structural integrity of the shroud 10/74.

Figure 9:
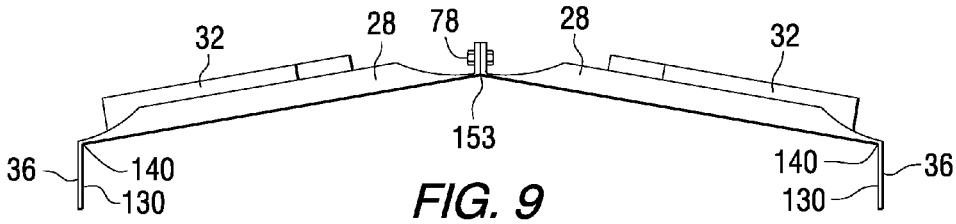
FIG. 9 is a rear view of the second embodiment of the heat extractor.
Figure 10:
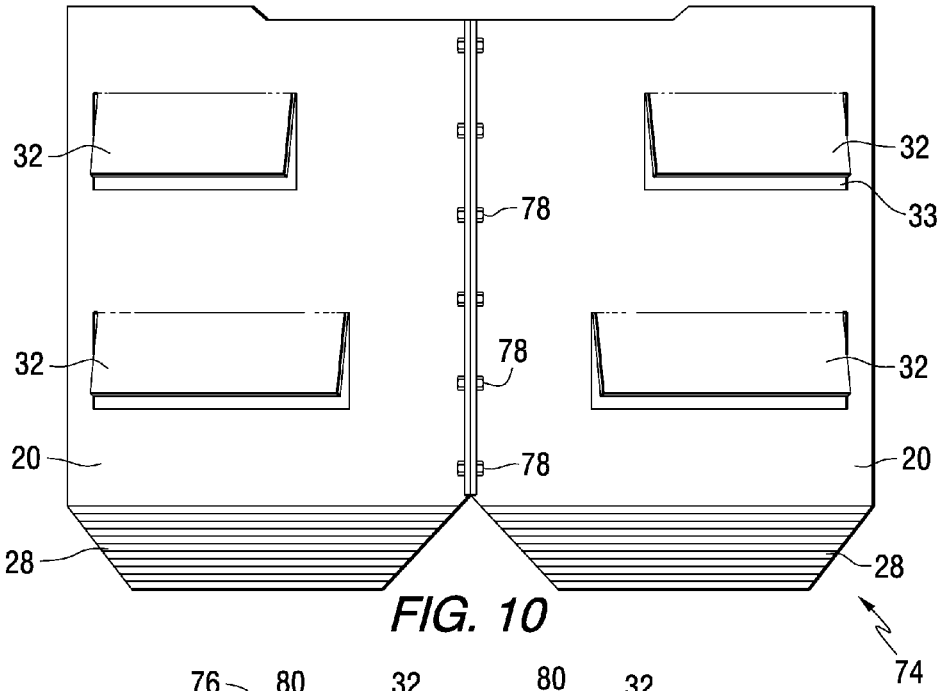
FIG. 10 is a top view of the second embodiment of the heat extractor.
Figure 11:
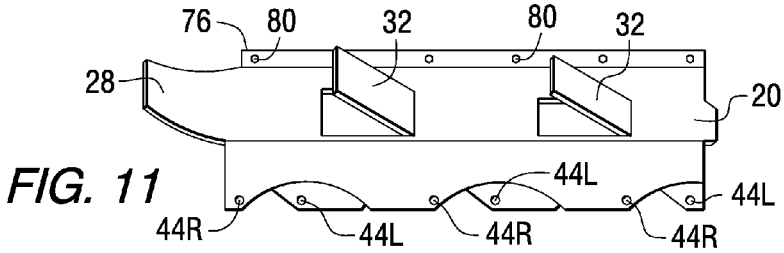
FIGS. 11 and 12 are respective right and left side views of the second embodiment of the heat extractor.
Figure 12:
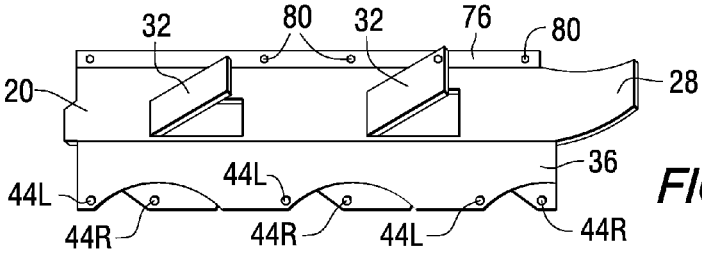

A first tape strip is affixed to the side surfaces 36 lengthwise in a region generally indicated by a reference character 130 in FIGS. 3 and 9. A second tape strip is affixed to the side surfaces 36 lengthwise in a region of the angle 140 formed at a junction between the major surface 20 and the side surfaces 36. The second tape strip may be sufficiently wide to extend across the angle 140 onto both the major surface 20 and the side surfaces 36.

The center reinforcement plate 124 is affixed to both sides of a line 152 on an underside surface of the major surface 20, as illustrated in FIG. 3. The line 152 is immediately below the common centerline 24. In the second shroud embodiment, the center reinforcement plate 124 is affixed in a region 153 as illustrated in FIG. 9. The center reinforcement plate 124 is affixed with one or both of double-sided adhesive tape strips and rivets as described above.

Figure 15:
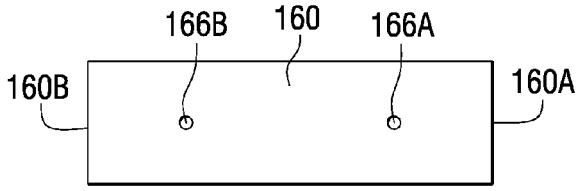
FIG. 15 illustrates cooling plates for use with the heat extractor of the present invention.

Yet another embodiment of the shroud 10/74 comprises two rectangular plates 160, illustrated in FIG. 15, for mounting under the cylinders or cylinder heads on both sides of the engine. Generally, the plates 160 are constructed of a thermally conductive material (such as aluminum) and are typically about 15 inches long, about 4.5 inches wide and have the same thickness as the shroud 10/74.

Figure 17:
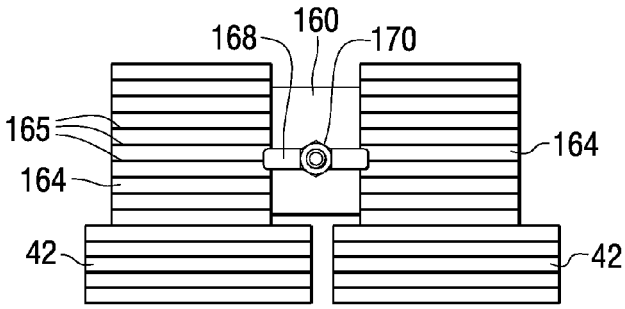

One plate 160 is mounted in contact with an underside surface of the cylinders or cylinder heads that extend from each side of the engine. FIG. 16 illustrates a side view of a single cylinder 164, its associated cylinder head 42 and the plate 160. Cooling fins 165 are also illustrated. FIG. 17 illustrates a top view of two adjacent cylinder heads 42 and their associated cylinders 164. The plate 160 is mounted by placing a bolt 162 in each hole 166, placing the plate 160 against the underside surface and attaching a wing nut 168 to a free end of the bolt 162 from a top of the engine. Each of the two wing nuts 168 (only one illustrated in FIGS. 16 and 17) is threaded along the bolt 162 until the wing nut is wedged or urged between two adjacent cylinders or cylinder heads, as depicted in FIG. 17. This mounting technique creates a force on the wings nuts 168 that restrains the plate 160 against the underside of the cylinders 164 or cylinder heads 42. A nut 170 is threaded onto each bolt 162 over each wing nut 168. The use of the two plates 160, one on each side of the engine, improves engine performance by significantly reducing the cylinder temperatures, which in turn reduces wear on internal engine parts. Reduced wear results in longer engine life and better engine performance.

The holes 166 may not be symmetrically disposed on the plate 160. Generally, a hole 166A proximate the engine propeller when the plate 160 is mounted on the engine is spaced a greater distance from an edge 160A than a hole 166B is spaced from an edge 160B. The plates 160, their size and shape and placement of the holes 166 is dependent on the type of engine with which the shroud 10/74 and the plates 160 will be used.

The shrouds of the various embodiments are for use with any air cooled engines, including Lycoming engines manufactured by Textron of Williamsport, Pa. and various engines manufactured by Teledyne Continental Engines of Mobile, Ala.

As described, the heat extractor and associated elements of the present invention are a unique and non-obvious product for efficiently removing heat from an air cooled engine. Although the invention has been shown and described with respect to certain preferred embodiments, it is obvious that equivalent alterations and modifications will occur to others skilled in the art upon reading and understanding this specification and the annexed drawings. In particular regard to the various functions and attributes performed by the above described elements, these are intended to correspond to any element that performs the specified function of the described element (i.e., that is functionally equivalent), even though not structurally equivalent to the disclosed structure. In addition, while a particular feature of the invention may have been disclosed with respect to only one of several embodiments, such feature may be combined with one or more other features of the other embodiments as may be desired and advantageous for any given or particular application.

What is claimed is:

1. A heat extractor for attachment to an air-cooled engine, the engine having a cooling fan extending from the engine and rotated by action of the engine, the heat extractor comprising:

a first thermally conductive surface for attachment to the engine, the first surface defining a first midline substantially aligned with a second midline of the engine, and comprising a substantially flat first portion extending in a first direction from the first midline and inclined toward the engine and a substantially flat second portion extending in a second direction from the first midline and inclined toward the engine, the first direction opposite to the second direction;

a plurality of flaps extending from the first surface, wherein when the heat extractor is attached to the engine the flaps extend away from the engine, and wherein flaps farther from the cooling fan are shorter than flaps nearer the cooling fan;

a flared end region formed in the first surface and extending upwardly away from the engine, the flared end region nearest the cooling fan when the heat extractor is attached to the engine; and wherein rotation of the cooling fan causes air to be drawn across the first surface, the plurality of flaps and the flared end region.

2. The heat extractor of claim 1 wherein the cooling fan comprises a propeller, and wherein the engine is mounted in an airboat and the propeller provides motive power to the airboat.

3. The heat extractor of claim 1 wherein the first thermally conductive surface comprises a continuous sheet of thermally conductive material.

4. The heat extractor of claim 1 wherein a material of the first thermally conductive surface comprises aluminum.

5. The heat extractor of claim 1 wherein the heat extractor further comprises first and second side surfaces extending from opposing edges of the first surface and extending in a direction opposite the plurality of flaps, and wherein the first and second side surfaces are attached to the engine on respective right and left sides of the engine.

6. The heat extractor of claim 5 wherein the first and the second side surfaces define openings therein for receiving a bolt further received in a hole in the engine, a nut for mating with the bolt and a washer disposed on each surface of the first and the second side surfaces.

7. The heat extractor of claim 6 wherein the washer comprises a stainless steel surface opposite a rubber surface.

8. The heat extractor of claim 1 further comprising first and second plates mounted on respective left and right sides of an underside surface of the engine in a region of engine cylinders.

9. The heat extractor of claim 8 wherein the first and second plates each define at least two holes therein, and wherein a bolt is received within each hole and a wing nut threaded onto the bolt, the wing nut wedged between two adjacent cylinders to restrain the respective first and second plates against the underside surface of the engine in the region of the engine cylinders.

10. A heat extractor for attaching to an air-cooled engine of an airboat, the engine having a propeller extending from the engine and rotated by action of the engine, the heat extractor comprising:

a first thermally conductive aluminum surface having a first midline substantially aligned with a second midline of the engine and the first surface spaced apart from and substantially covering a top of the engine when the heat extractor is attached to the engine, the first surface comprising a substantially flat first portion extending in a first direction from the first midline and inclined toward the engine and a substantially flat second portion extending in a second direction from the first midline and inclined toward the engine, the first direction opposite the second direction;

a plurality of flaps extending from the first surface, the flaps extending away from the engine when the heat extractor is attached to the engine, wherein flaps farther from the cooling fan are shorter than flaps nearer the cooling fan;

a flared end region disposed nearest the propeller when the heat extractor is attached to the engine, the flared end region extending upwardly away from the engine;

first and second side surfaces extending from opposing edges of the first surface in a direction opposite the plurality of flaps, wherein the first and second side surfaces are attached to the engine;

first and second reinforcement plates attached to an inside surface of the first and the second side surfaces;

a third reinforcement plate attached to an inside surface proximate the first midline of the first surface; and wherein rotation of the propeller causes air to be drawn across the first surface, the plurality of flaps and the flared end region.

11. The heat extractor of claim 10 further comprising a fourth and a fifth plate mounted on respective left and right sides of an underside surface of the engine in a region of engine cylinders, the fourth and fifth plates each defining at least two holes therein, and wherein a bolt is received within each hole and a wing nut threaded onto the bolt, the wing nut wedged between two adjacent cylinders to restrain the fourth and fifth plates against the underside surface of the engine in the region of the engine cylinders.

* * * * *